United States Patent [19]

Komatsu et al.

[11] Patent Number: 4,867,900

[45] Date of Patent: Sep. 19, 1989

[54] PAINT PEELING COMPOSITION

[75] Inventors: Keisaku Komatsu; Toshimi Ohwatari; Takashi Yamada, all of Youkaichi, Japan

[73] Assignee: Kaken Kogyo, Co., Ltd., Hirakata, Japan

[21] Appl. No.: 251,001

[22] Filed: Sep. 27, 1988

Related U.S. Application Data

[63] Continuation of Ser. No. 22,166, Mar. 5, 1987, abandoned.

[51] Int. Cl.[4] ..... B08B 7/00; C11D 7/50

[52] U.S. Cl. ..... 252/174.23; 252/DIG. 1; 252/DIG. 3; 252/DIG. 8; 134/4; 134/38; 427/350; 427/373

[58] Field of Search ..... 521/65, 72; 428/313.3, 428/315.3; 427/350, 373; 134/4, 38; 252/174.23, DIG. 3, DIG. 8, DIG. 2

[56] References Cited

U.S. PATENT DOCUMENTS

| | | | |
|---|---|---|---|
| 2,811,456 | 10/1957 | Coleman | 134/4 |
| 3,238,156 | 3/1966 | Kohrn | 260/2.5 |
| 3,635,827 | 1/1972 | Jakobi | 252/174.23 |
| 3,689,435 | 9/1972 | Berni | 252/174.23 |
| 3,819,525 | 6/1974 | Hatterbrun | 252/174.23 |
| 3,846,172 | 11/1974 | Fossatti | 134/38 |
| 3,979,339 | 9/1976 | Claybough | 252/174.23 |
| 4,082,702 | 4/1978 | Harper | 260/2.5 AK |
| 4,199,375 | 4/1980 | Muller | 134/4 |
| 4,252,378 | 2/1981 | DeBolt | 301/63 DD |
| 4,262,052 | 4/1981 | Kannan | 428/306 |
| 4,363,690 | 12/1982 | Gagliani | 156/307.5 |
| 4,386,166 | 5/1983 | Peterson | 521/99 |
| 4,626,372 | 12/1986 | Kaufmann | 252/174.23 |

FOREIGN PATENT DOCUMENTS

| | | | |
|---|---|---|---|
| 2106466 | 8/1972 | Fed. Rep. of Germany | 427/373 |
| 2822126 | 11/1979 | Fed. Rep. of Germany | 252/DIG. 8 |
| 0005049 | 2/1978 | Japan . | |
| 0195774 | 5/1981 | Japan . | |
| 0207626 | 12/1982 | Japan . | |

OTHER PUBLICATIONS

Ser. No. 007300 filed 1-27-87, Komatsu et al.

*Primary Examiner*—Paul Lieberman
*Assistant Examiner*—Kathleen Markowski
*Attorney, Agent, or Firm*—Jordan and Hamburg

[57] ABSTRACT

A paint peeling composition contains as effective components (1) a water-insoluble high polymer compound such as unreamelamine resin, chloroprene latex, EVA latex, or polystyrene; and (2) a substance containing as an effective component thereof, a component capable of forming a group of minute bubbles in an applied coating per se, e.g., a foamed or unfoamed hollow matter, or a chemical system capable of reacting to form a gaseous foam.

12 Claims, No Drawings

PAINT PEELING COMPOSITION

BACKGROUND OF THE INVENTION

This application is a continuation of application Ser. No. 022,166, filed Mar. 5, 1987, abandoned.

The present invention relates to a paint peeling composition for peeling off unnecessary paint adhered to objects not to be painted such as a hanger for transporting by lifting an object to be painted, a masking tool, a table for mounting thereon an object to be painted, a painting booth and the like.

Known methods for peeling off unnecesary paint adhered to objects not to be painted may be generally typed as chemical methods, such as dissolving or decomposing the paint by organic solvents, acids or alkaline solutions, and as physical methods such as using a stripper or a hammer and spraying a hyperpressured water thereon after burning the paint at a high temperature.

Problems with the chemical methods will be described next.

The organic solvent treatment is considerably time-consuming or does not cause any effect depending on conditions further, the treatment may pose fire or human health hazards. When using acid or alkaline solutions, the methods tend to remain ineffective unless the solutions contain considerably large amounts of acid or alkali or the solutions are heated or unless the treatment is carried out over a considerably long time period. In addition, there are also problems, e,g, of possible human health hazard, proper maintenance and control of the paint peeling solution, disposal of waste liquid, development of rust on the hanger and the like from which the adhered unnecessary paint along with applied rust inhibiting paint has been peeled off, and further a problem of necessity of special technique and devices for the treatment.

As for the physical method using a stripper, a hammer and the like, since the paint is not readily or completely peeled off, the method requires considerable labor. In a worst case which occurs rather frequently, the hanger or the tool is deformed or broken.

As for the case where the paint is treated by high temperature or by chemicals and then the deteriorated paint is removed by spraying thereover a hyper-pressured water, an apparatus is needed for generating the hyper-pressurized water; further, for heat-resisting paints, a considerable amount of thermal energy is needed for the treatment and the chemical treatments cause the aforementioned troubles.

Recently, there has been disclosed a method capable of readily peeling off the paint adhered to an object not to be painted in which a paint peeling composition containing as effective components thereof a thermoplastic resin which is solid at normal temperature, another thermoplastic resin and an organic solvent is pre-applied to the object not to be painted (e.g. Japanese patent application published or laid open under NO. 57-195774).

According to this method, when unnecessary paint is accumulatedly adhered to the coating pre-applied to the object, a surface of the paint is struck by a hammer and the like in order to peel the coating off the object and at the same time to cause a crack in the coating and the paint, whereby the coating and the paint are peeled off the object together.

Thus, in comparison with the conventional paint peeling methods, with this method, it is possible to readily peel off the unnecessary paint without using any special apparatus. However, much of the mechanical impact applied to the coated surface is absorbed into the object per se through the coating. Therefore, a considerable impact is needed to cause the crack in the paint.

SUMMARY OF THE INVENTION

It is an object of the present invention to provide a useful paint peeling composition with which it is possible to, speedily and readily without much labor, peel off the unnecessary paint adhered to the object not to be painted retaining as well the same advantage of the recently-developed paint peeling composition.

A characterizing feature of the paint peeling composition related to the present invention lies in that the composition contains as effective components thereof a water-insoluble high polymer compound and a substance capable of forming a group of minute bubbles in the applied coating per se.

In operation, by coating a surface of an object not to be painted with the above paint peeling composition of the present invention, there is formed a coating having minute bubbles on the surface. Then, as a painting operation proceeds whereby unnecessary paint is accumulatedly adhered to the surface of the coating, a mechanical impact is applied to the paint surface, whereby the coating is smashed to be significantly reduced in volume creating a large gaseous layer (constituted by the group of minute bubbles) used for peeling between the object and the paint and also creating a crack in the paint.

Since the large gaseous layer for peeling between the object and the paint may be created with an extremely small mechanical impact, compared with the conventional methods, the paint peeling composition related to the present invention, not only achieves the same advantageous effects as the recently-developed paint peeling composition but also is superior in apparatus, thermal energy requirements and safety and is capable of peeling off the unnecessary paint adhered to the object not to be painted readily, speedily and without much labor.

In addition to the above advantages, since water-washing, waste liquid neutralization, maintenance and control of the treatment liquid and the drying operation are not needed after the paint peeling operation, it is possible to reduce apparatus of implements needed for the above operations. Further, since it is possible to immediately apply the paint peeling composition, the coating re-treatment time period for the object not to be painted is significantly reduced.

DETAILED DESCRIPTION OF THE PREFERRED EMBODIMENTS

A paint peeling composition related to the present invention contains as effective components thereof a water-insoluble high polymer compound and a substance capable of forming a group of minute bubbles in the applied coating per se.

Methods for forming a group of minute bubbles in the coating per se using the above composition are as follows:

(a) A minute foamed hollow matter such as shirasu balloon, glass balloon, carbon balloon and synthetic resin ballon is added to the coating forming substance;

(b) A minute unfoamed hollow matter such as synthetic resin balloon is added to the coating forming substance and then baked to generate foams;

(c) A matter which is stable at the normal temperature and self-decomposes at a high temperature to generate gas is added to the coating forming substance and then baked to generate foams;

(d) A reactive chemical matter is added whereby gaseous foams are generated through a chemical reaction;

(e) As in the case of, e.g. foamed urethane, gas generated as a by-product of a chemical reaction in the course of hardening is utilized for foaming;

(f) A low-boiling solvent is added to the coating-forming substance and then baked to generate foams;

(g) The coating-forming substance is pre-mixed with a solvent which does not dissolve or hardly dissolves the substance, thereby forming the coating having a gaseous layer therein; and (h) The coating-forming substance is pre-mixed with highly-pressured nitrogen or Freon (fluorocarbon) gas, and then reduced to atmospheric pressure to generate foams.

The aforementioned water-insoluble high polymer compound constituting the coating-forming substance includes ureamelamine resin, chloroprenelatex, EVA (ethylene vinylacetate copolymer) latex, polystyrene and the like, one of which or two or more of which in combination may be used. The water-insoluble high polymer compound includes other matters also which will not be described here.

In addition to the above components, a swelling inorganic matter capable of swelling the coating when needed, a rust inhibiter, a coherence-promoting agent and the like may be conveniently added. The swelling inorganic matter includes Na $Mg_{2.5}$ $(Si_4\ O_{10})F_2$, Li $Mg_{2.5}$ $(Si_4\ O_{10})F_2$, Li $Mg_2Li$ $(Si_4O_{10})F_2$ and so on.

There are also other methods for forming minute bubbles in the coating.

In preparing the present coating-forming substance, various selections or combinations of components are available depending on its purpose and conditions.

In some painting factories, an alkali degreasing treatment and a zinc phosphate treatment are carried out before painting; and in many painting factories, a water soluble paint is used or an electrodeposition painting is carried out. In such cases, if such a high polymer material as melamine resin having alkali resistant and acid resistant characteristics is selected to be used as the substance forming the coating, it becomes possible to carry out all pretreatment prior to painting, painting and baking in one production line.

Since the water-insoluble high polymer matter is used as the coating-foming substance as described above, the paint peeling composition of the present invention is superior in chemical resistance to the conventional composition containing an aqueous or water-soluble high polymer matter, thus being extremely useful in actual painting operations.

Further, in case a high-temperature baking operation is not feasible, e.g. at a painting booth, if a composition prepared by diluting a thermoplastic high polymer resin with a solvent having a suitable drying speed is selected to be used as the coating-forming substance thereby to form a coating having minute bubbles by the above-described method and the like, even if unhardened unnecessary paint is accumulated thereon in considerable thickness, the paint may be readily peeled off by inserting a metal stripper and the like into the gaseous layer.

Specific embodiments of the paint peeling composition will now be particularly described.

Embodiment - 1

| | |
|---|---|
| ureamelamine resin | 40 weight parts |
| synthetic mica | 8 weight parts |
| synthetic resin balloon | 2 weight parts |
| water | 50 weight parts |

A mixture of the above components was applied to an iron bar (5ϕ×200 mm) by dipping to form a coating of approximately 0.2–0.5mm in thickness thereon and then baked for 30 minutes at 160° C. After the baking, the coating constituted by the paint peeling composition of the present invention had its thickness increased by foaming reaction by about 2 times (about 0.4–1 mm).

In this condition, after the iron bar with the coating was submerged an alkali degreasing liquid and in a zinc phosphate treatment liquid, respectively, for 10 minutes, no abnormalities were observed. Thereafter, the bar was sprayed over with paint and then baked for 30 minutes at 160° C. These operations were repeated a few tens of times until the paint was accumulatedly adhered thereon to be approximately 3 mm in thickness.

When this was lightly struck by a hammer, the accumulated paint was cracked and readly peeled off the iron bar. Likewise, when the same was stamped by a foot, the paint was cracked and readily peeled off the bar also.

EMBODIMENT - 2

| | |
|---|---|
| Chloroprene latex | 75 weight parts |
| carbon balloon | 25 weight parts |

A mixture of the above components was applied to an iron plate (300×300×0.5 mm) to form a coating thereover having average thickness of 1 mm and then air-dried for 4 hours.

After the coated plate was left as it was at an actual painting site for 2 weeks, paint having an average thickness of 32 mm was accumulatedly adhered thereon.

When a metal stripper was inserted into bubbles formed inside the paint peeling composition, all unnecessary paint was readily peeled off the plate.

The same composition was applied by dipping therein an iron bar (5ϕ×200 mm) to form thereon a coating of approximately 1 mm in thickness and then baked for 30 minutes at 160° C. In this condition, after the iron bar with the coating was submerged in an alkali degreasing liquid and in a zinc phosphate treatment liquid respectively for 10 minutes, no abnormalities were observed. Thereafter, the bar was sprayed over with paint and then baked for 30 minutes at 160° C. These operations were repeated a few tens of times until the paint was accumulatedly adhered thereon to be approximately 3 mm in thickness.

When this was lightly struck by a hammer, the accumulated paint was cracked and readily peeled off the iron bar.

EMBODIMENT - 3

| | |
|---|---|
| Chloroprene latex | 96 weight parts |

-continued

| | |
|---|---|
| foamed synthetic resin balloon | 4 weight parts |

A mixture of the above components was applied to an iron plate (300×300×0.5 mm) to form a coating thereover having an average thickness of 2 mm and then air-dried for 4 hours.

After the coated plate was left as it was at an actual painting site for 2 weeks, paint having an average thickness of 32 mm was accumulatedly adhered thereon.

When a metal stripper was inserted into bubbles formed inside the paint peeling composition, all unnecessary paint was readily peeled off the plate.

The same composition was applied by dipping therein an iron bar (5ϕ×200 mm) to form thereon a coating of approximately 1 mm in thickness and then air-dried for 4 hours. In this condition, after the iron bar with the coating was submerged in an alkali degreasing liquid and in a zinc phosphate treatment liquid respectively for 10 minutes, no abnormalities were observed.

Thereafter, the bar was sprayed over with paint and then baked for 30 minutes at 160° C. These operations were repeated a few tens of times until the paint was accumulated adhered thereon to be approximately 3 mm in thickness.

When this was lightly struck by a hammer, the accumulated paint was cracked and readily peeled off the iron bar. At this point, it was confirmed that the paint peeling composition had been shrunk by the heat.

EMBODIMENT - 4

| | |
|---|---|
| EVA latex | 20 weight parts |
| synthetic mica | 8 weight parts |
| unfoamed synthetic resin ballon | 2 weight parts |
| water | 70 weight parts |

A mixture of the above components was applied to an iron bar (5ϕ×200 mm) by dipping to form a coating of approximately 0.2–0.5 mm in thickness thereon and then baked for 30 minutes at 160° C. After the baking, the coating constituted by the paint peeling composition of the present invention had its thickness increased by foaming reaction by about 2 times (about 0.4–1 mm).

In this condition, after the iron bar with the coating was submerged in an alkali degreasing liquid and in a zinc phosphate treatment liquid respectively for 10 minutes, no abnormalities were observed. Thereafter, the bar was sprayed over with paint and then baked for 30 minutes at 160° C. These operations were repeated a few tens of times until the paint was accumulated adhered thereon to be approximately 3 mm in thickness.

The minute bubbles formed by the synthetic resin ballon disappear when the heating time at a temperature between 130°–180° C. exceeds 10 hours and with this disappearance the volume of the composition is also reduced.

When the coated bar was lightly struck by a hammer, the accumulated paint was cracked and readily peeled off the bar. Likewise, when the same was stamped by a foot, the paint was cracked and readily peeled off the bar also. In the above operations, since EVA had changed in properties and discolored to be blackish and was adhered to the paint surface not to the metal surface, the EVA was peeled off the metal surface together with the unnecessary paint with a light impact.

EMBODIMENT - 5

| | |
|---|---|
| toluene solution containing 20% of polystyrene | 96 weight parts |
| foamed synthetic resin ballon | 4 weight parts |

A mixture of the above components was applied by dipping therein an iron bar (5ϕ×200 mm) to form thereon a coating of approximately 1 mm in thickness and then backed for 30 minutes at 160° C. Thereafter, the bar was sprayed over with paint and then baked for 30 minutes at 160° C. These operations were repeated a few tens of times until the paint was accumulatedly adhered thereon to be approximately 3 mm in thickness.

When this was lightly struck by a hammer, the accumulated paint was cracked and readily peeled off the iron bar.

EMBODIMENT - 6

| | |
|---|---|
| toluene solution containing 50% of polystyrene | 90 weight parts |
| acetone solution containing 15% of azobisisobutyronitrile | 10 weight parts |

A mixture of the above components was applied by dipping therein an iron bar (5ϕ×200 mm) to form thereon a coating of approximately 0.2–0.5 mm in thickness and then baked for 30 minutes at 140 ° C. In this condition, after the iron bar with the coating was submerged in an alkali degreasing liquid and in a zinc phosphate treatment liquid respectively for 10 minutes, no abnormalities were observed.

Thereafter, the bar was sprayed over with paint and then baked for 30 minutes at 160° C. These operations were repeated a few tens of times until the paint was accumulatedly adhered thereon to be approximately 3 mm in thickness.

When this was lightly struck by a hammer, the accumulated paint was cracked and readily peeled off the iron bar. Likewise, when the same was stamped by a foot, the paint was cracked and readily peeled off the bar also.

EMBODIMENT - 7

| | |
|---|---|
| polystyrene | 20 weight parts |
| unfoamed synthetic resin ballon | 5 weight parts |
| xylene | 70 weight parts |
| thixotropy promoting agent, antiseptic agent, coherence promoting agent and the like | 5 weight parts |

A mixture of the above components was applied by dipping therein an iron bar (5ϕ×200 mm) to be approximately 0.4 mm in thickness and then air-dried for 2 hours thereby forming a coating having a 0.2 mm thickness.

Then, as in the an actual painting procedure, the iron bar with the coating was submerged in an alkali degreasing liquid and in a zinc phosphate treatment liquid, respectively. Thereafter, the bar was sprayed over with paint and then baked in an oven for 30 minutes at 160° C.

In this condition, the coating showed no abnormalities even when the same was dipped in the alkali degreasing liquid and in the zinc phosphate treatment liquid. Further, the coating, after being baked in the oven, developed approximately two times in thickness (0.4 mm) because of a cubic expansion of the unfoamed synthetic resin balloon caused by the heat.

When the coated bar was left for a while on the painting line to be exposed to the paint repeatedly, the unnecessary paint was accumulatedly adhered thereto to be several millimeters in thickness.

At this point, by heating for a long time, the synthetic resin balloon, which had been foamed before, again reduced in volume forming bubbles between the metal surface and the paint.

When this was lightly struck by a hammer, the accumulated paint was cracked as a voluminous mass and readily peeled off the iron bar.

In the above operations, since the paint peeling composition of the present invention had changed in properties and disclosed to be blackish and was adhered to the paint surface but not to the metal surface, the composition was peeled off the metal surface together with the unnecessary paint with a light impact.

What is claimed is:

1. A paint peeling method comprising the steps of:

applying to an object not to be painted a paint peeling composition containing as effective components thereof 20 to 96% by weight of a coating-formable water-insoluble high polymer compound and 2 to 25% by weight of a substance capable of forming a group of minute bubbles in an applied coating per se;

curing said paint peeling composition to form a coating on the object and causing said substance to expand in volume; and peeling the coating off the object after excess paint has been accumulated thereon together with the accumulated excess paint, the expansion in volume of said substance facilitating the peeling of the coating off the object.

2. A paint peeling method as defined in claim 1, wherein said water-insoluble high polymer compound comprises at least one selected from the group consisting of ureamelamine resin, chloroprene latex, ethylene vinyl-acetate copolymer latex and polystyrene.

3. A paint peeling method as defined in claim 1, wherein said substance comprises a foamed hollow matter.

4. A paint peeling method as defined in claim 3, wherein said foamed hollow matter comprises at least one selected from the group consisting of shirasu balloons, glass balloons, carbon balloons and foamed synthetic resin balloons.

5. A paint peeling method as defined in claim 1, wherein said substance comprises an unfoamed hollow matter capable of foaming upon baking after being applied to the object not to be painted.

6. A paint peeling method as defined in claim 5, wherein said unfoamed hollow matter comprises a synthetic resin balloon.

7. A paint peeling method as defined in claim 1, wherein said substance comprises a matter capable of self-decomposing to generate gas when baked after being applied to the object not to be painted.

8. A paint peeling method as defined in claim 7, wherein said matter capable of self-decomposing contains a an effective component thereof azobisisobutyronitrile.

9. A paint peeling method as defined in claim 1, wherein said substance comprises a chemical matter capable of generating gas by a chemical reaction after being applied to the object not to be painted.

10. A paint peeling method as defined in claim 1, wherein said substance comprises a low boiling solvent to be foamed by baking after being applied to the object not to be painted.

11. A paint peeling method as defined in claim 1, wherein said substance comprises highly-pressured fluorocarbon gas to be foamed when the pressure is reduced to atmospheric pressure after being applied to the object not to be painted.

12. A paint peeling method as defined in claim 1, wherein said paint peeling composition has a ratio of high polymer compound to bubble-formable substance ranging in % by weight from 24:1 to 3:1.

* * * * *